United States Patent [19]

Niemeck et al.

[11] Patent Number: 4,907,893

[45] Date of Patent: Mar. 13, 1990

[54] THERMO-ROTO MIXER APPARATUS

[76] Inventors: Graciela Niemeck, 5519 York, New Orleans, La. 70125; James Borgerson, Box 708, 31 McAlister Dr., New Orleans, La. 70118-5555

[21] Appl. No.: 264,899

[22] Filed: Oct. 31, 1988

[51] Int. Cl.[4] ..... B01F 15/06

[52] U.S. Cl. ..... 366/144; 366/208; 494/13

[58] Field of Search ..... 366/144, 145, 146, 147, 366/148, 149, 208, 209, 213, 214, 215, 217, 218; 494/13, 14

[56] References Cited

U.S. PATENT DOCUMENTS

| | | | |
|---|---|---|---|
| 1,321,288 | 11/1919 | Dalzell | 494/13 |
| 3,163,404 | 12/1964 | Kraft | 366/214 |
| 3,231,244 | 1/1966 | Moody | 366/214 |
| 3,246,688 | 4/1966 | Colburn | 494/14 |
| 4,498,896 | 2/1985 | Leis | 494/13 |

*Primary Examiner*—Robert W. Jenkins

*Attorney, Agent, or Firm*—Pravel, Gambrell, Hewitt, Kimball & Krieger

[57] ABSTRACT

What is provided is an apparatus designated as a thermo-roto mixer which would provide a blood specimen mixer portion, comprising a plurality of test tube cradles for housing the test tubes containing blood, so that in the closed position, the test tubes are housed within the cradles within the mixing portion at a desired temperature. The mixing portion is fastened to a shaft supporting the test tube holder assembly, the shafts maintaining the assembly in an overall main frame. The assembly is rotated by the use of a motor pulley assembly, to impart general rotation on the test tube holder assembly.

5 Claims, 8 Drawing Sheets

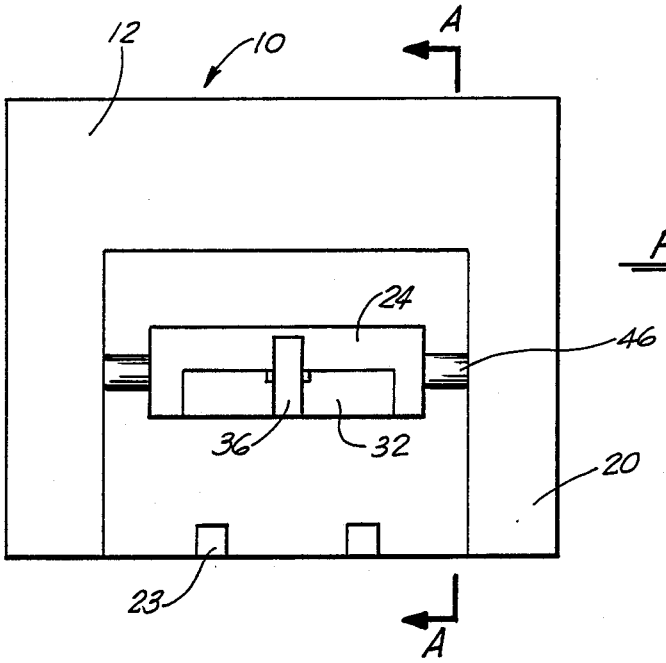
FIG. 2a
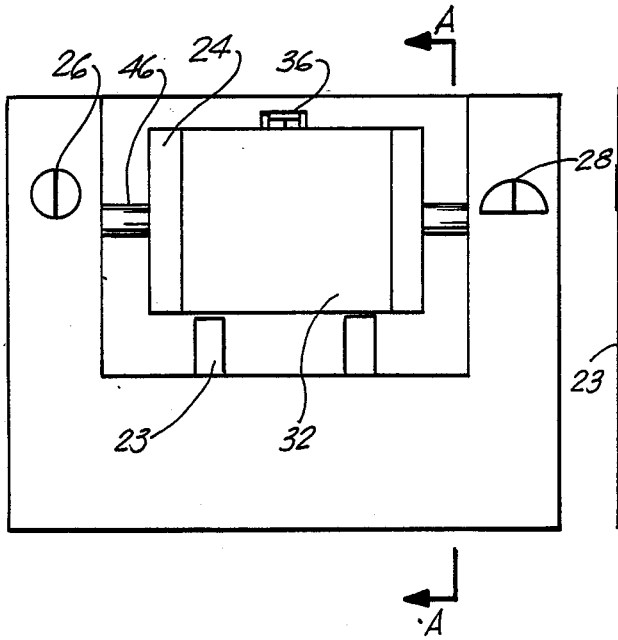
FIG. 2b
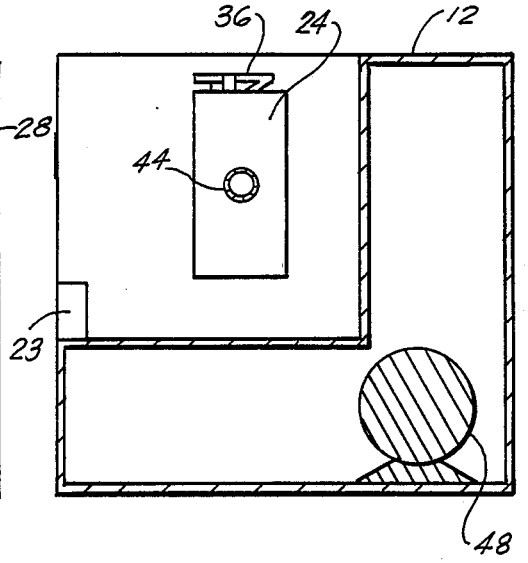
SECTION A-A

THERMO-ROTO MIXER APPARATUS

BACKGROUND OF THE INVENTION

1. Field of the Invention

The apparatus of the present invention relates to preparation of laboratory blood specimens. More particularly, the present invention relates to an apparatus for gently rotating and mixing a blood specimen at a specific temperature during preparation of the specimen for further testing.

2. General Background

In the testing of blood specimens in a hematology laboratory, there are problems which arise which result in inconsistent and poorly prepared blood specimens in the preparation of the specimens that occurs in the present state of the art. For example, the presence of cold agglutinins in blood specimens for blood cell counts (C.B.C.) have been a main problem confronted by hematology lab personnel in view of the fact that a blood specimen will clump if it reaches a temperature below 37° C. In addition, during the preparation of L.E. cells for the determination of Lupus Eritomatosus Diseminatus with heparinized specimens, the blood specimen will clot when a mixer, of the type of the present state of the art, is utilized to mix the blood in a back and forth pattern. This type of mixture has been found to be poorly suited in avoiding the clotting of the specimen during testing.

Therefore, there is a need in the art for an agitator for blood which allows the blood specimen to be maintained in the fluidized state under proper temperature, so the tests may be conducted on the blood and reflect the proper results.

Patents found in the present state of the art which may be pertinent are as follows:

| PATENT NO. | INVENTOR | TITLE |
|---|---|---|
| 4,479,720 | Mochida, et al. | "Apparatus For Rotating Reaction Vessels In Included Posture" |
| 3,317,125 | Holden | "Centrifuge Having Heat Sensitive Probe" |
| 3,246,688 | Colburn | "Controlled Temperature Apparatus" |
| 4,555,183 | Thomas | "High Speed Tube Agitator Apparatus" |
| 3,231,244 | Moody, et al. | "Automatic Blood Mixing Machine" |
| 3,163,404 | Kraft, et al. | "Rotary Apparatus For Agitating Fluids" |
| 3,890,227 | Witty, et al. | "Adjustable Rotator For Fluid Samples" |
| 3,614,434 | Hortwitz | "Automatic Agitating And Sample Device" |
| 3,747,900 | Dilts | "Blood Specimen Oscillator" |

SUMMARY OF THE PRESENT INVENTION

The apparatus of the present invention solves the short comings in the art in a simple and straight forward manner. What is provided is an apparatus designated as a thermo-roto mixer which would provide a blood specimen mixer portion, comprising a plurality of test tube cradles for housing the test tubes containing blood, so that in the closed position, the test tubes are housed within the cradles within the mixing portion. The mixing portion is fastened to a shaft supporting the test tube holder assembly, the shafts maintaining the assembly in an overall main frame. The assembly is rotated by the use of a motor pulley assembly, to impart general rotation on the test tube holder assembly. Further, there is provided a means for heating the test tube holder assembly with a brush/slip ring assembly located in a portion in the main frame so that the test tube cradles are maintained in a constant 37° C. Therefore, the tasks of gently rotated and agitating the blood contained within a test tube and the maintaining of the test tubes in constant temperature provide a means for maintaining the blood at the proper mixture and temperature required for testing.

Therefore, it is a principal object of the present invention to provide an apparatus for gently mixing and stirring samples of blood, and maintaining the blood samples at a desired temperature;

It is a further object of the present invention to provide an apparatus including a test tube holder assembly for accommodating a plurality of test tubes containing blood, so that once placed in the assembly, the test tubes can be gently rotated to accomplish mixing of the blood; and It is still a further object of the present invention to provide a thermal-roto mixer which while mixing the blood maintains the blood at the desired temperature for further testing in such a manner as to prevent clumping of the blood during the mixing process.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIGS. 2A through 2C are top, front and side cutaway views of the preferred embodiment of the apparatus of the present invention respectively;

DETAILED DESCRIPTION OF THE PREFERRED EMBODIMENT

Figure 1:
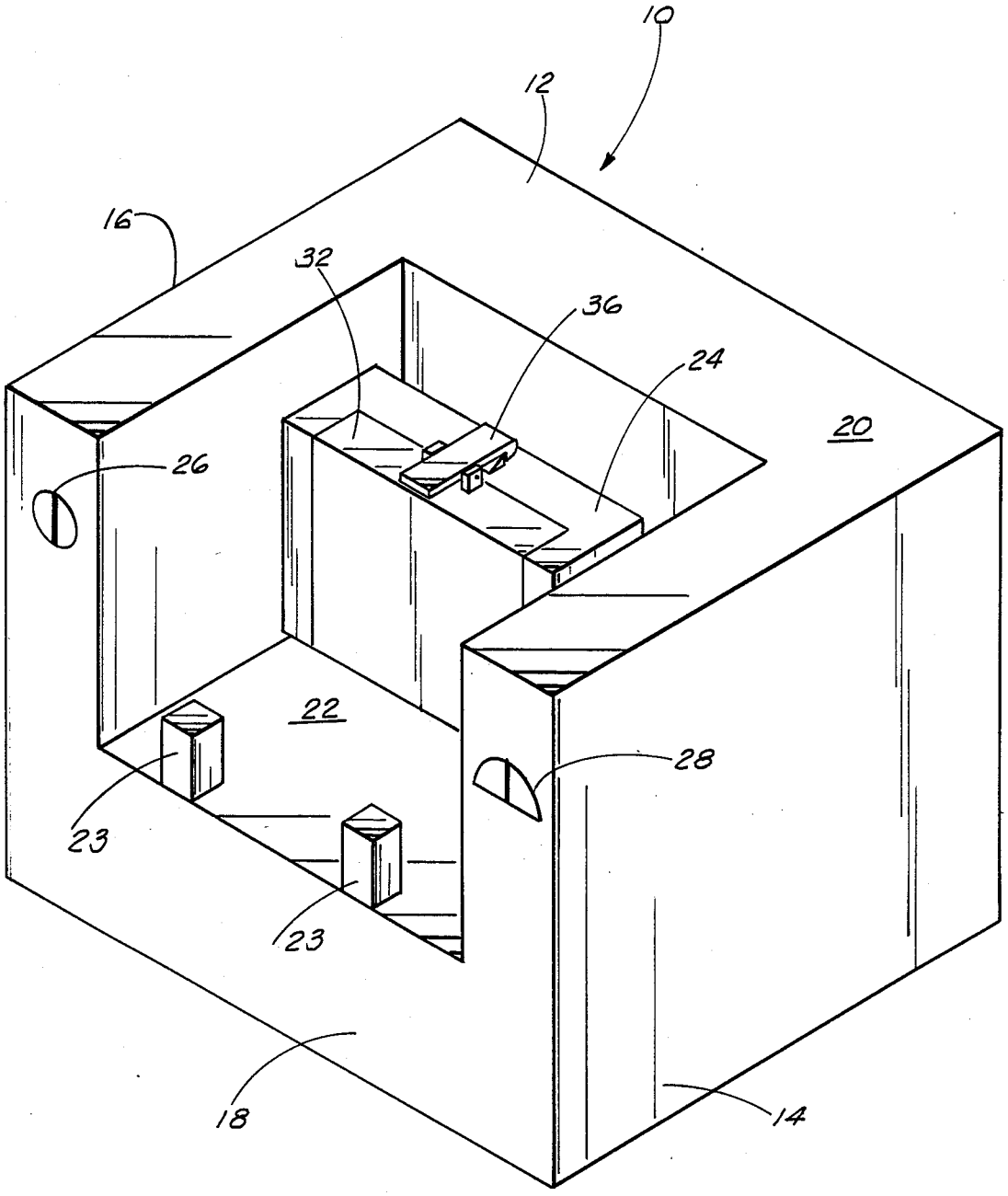
FIG. 1 is an overall perspective view of the preferred embodiment of the apparatus of the present invention.

The apparatus of the present invention is illustrated by the numeral 10, as illustrated particularly in FIG. 1. Thus seen in the Figures, apparatus 10 comprises a generally rectangular enclosure 12 having a pair of side walls 14 and 16 and a front wall 18, with a top wall 20. There is provided a space 22 for housing the test tube assembly portion 24 as will be discussed further. Contained within the remainder of the apparatus 10 are the internal assembly functions for use with the test tube assembly 24 as will be discussed further. As seen in FIG. 1, there are the controls 26 and 28, with control 26 comprising a four positioned switch having the positions of "off", "heat only", "rotate only", and "heat and rotate", for the various functions of the test tube assembly 24. Further, item 28 is a timer which can be set for various durations of time and foreseen as the total of sixty (60) minutes.

Figure 3:
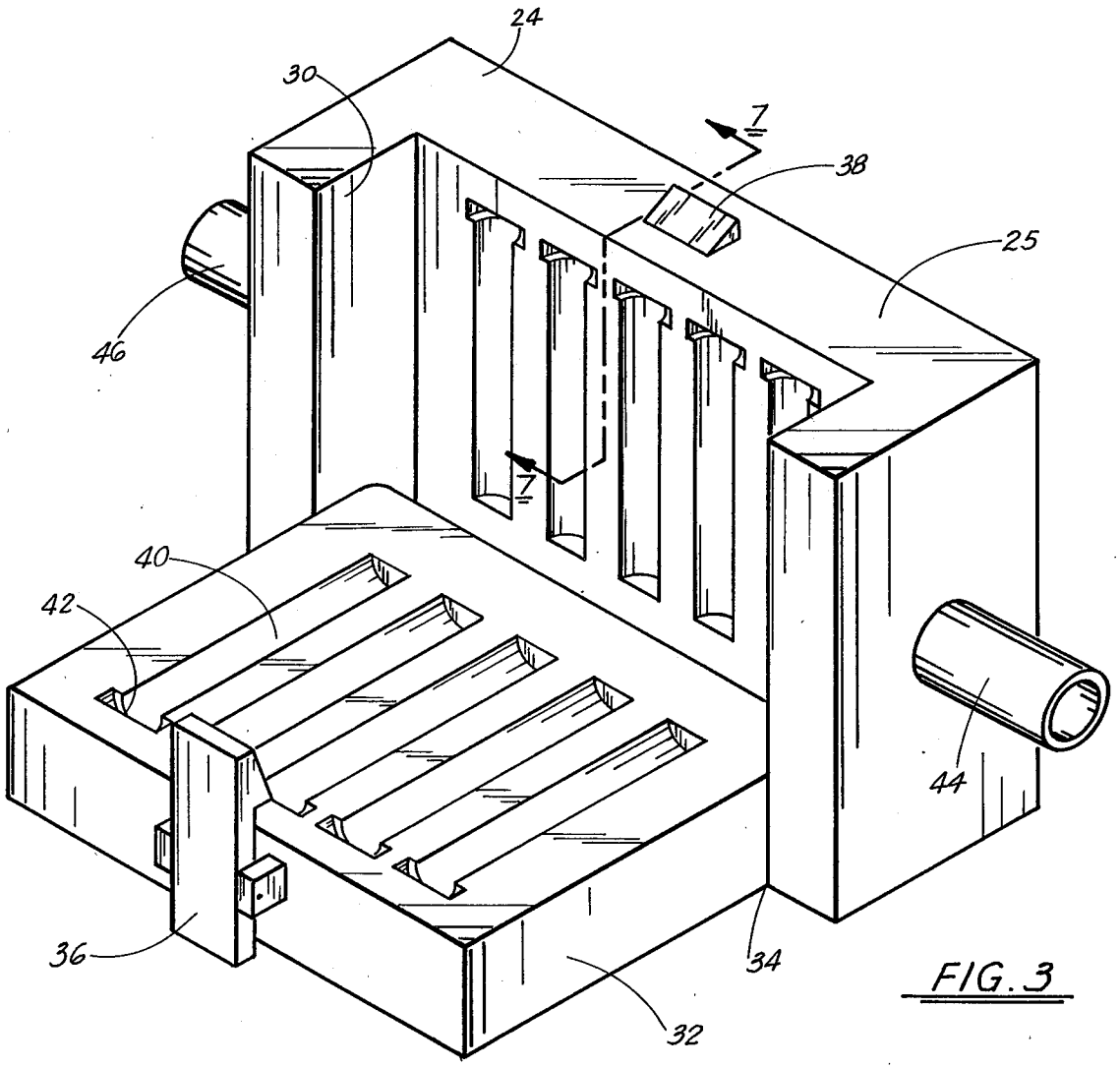
FIG. 3 illustrates the test tube assembly component in the preferred embodiment of the apparatus of the present invention.

Turning now to the rotor assembly itself, reference is made to FIG. 3 which illustrates tube assembly 24 having a main housing portion 30, with a door portion 32 hingedly attached at its base 34 with an upper locking mechanism 36 for latching onto the latch retainer 38 on the top wall 25 of the assembly 24. Contained within the housing 30 is a plurality of test tube holders which can be referred to as "cradles" 40 which are elongated hollows in the form of a test tube having expanded upper portion 42 for accommodating the upper lip portion of the tube. It should be noted that the cradles 40 are positioned substantially half of each cradle in the main housing of the assembly and the other half of the cradle in the door of the assembly, so that as the door is opened the test tubes are easily accessed after being placed into the housing.

Figure 4:
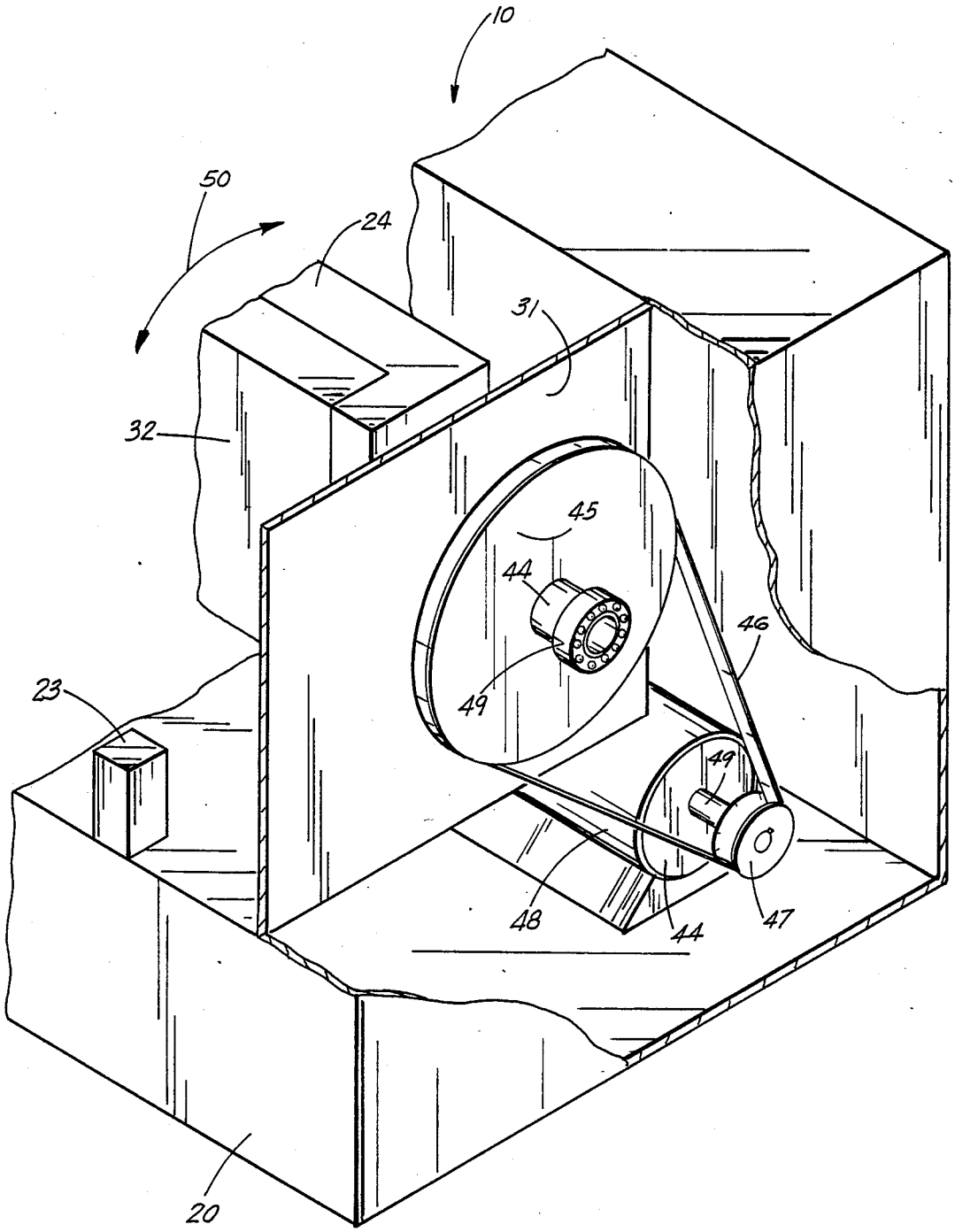
FIG. 4 illustrates a partial cutaway view of the drive assembly of the test tube holder assembly of the present invention.

Further, there is illustrated in FIG. 3, a pair of shafts 44 and 46 extending from each side wall of the test tube holder assembly, which will accommodate the rotative movement of the assembly during use. Further, as seen in FIG. 4, there is illustrated test tube assembly 24 positioned along the side wall 31 of housing 30, with shaft 44 extending through the side wall and accommodating a main pulley wheel 45, which has a continuous pulley belt 46 extending to a second drive wheel 47 attached to a drive motor 48 so that when rotation of the shaft 49 of motor 48 imparts rotation to the pulley wheel 45 and thus rotates test tube assembly in the direction of Arrow 50 as seen in FIG. 4. In this fashion, the test tube assembly is rotated after the test tube have been placed in position within cradles 40, and door portion 32 placed in the locked position as seen in FIG. 1. Motor 44 is designed so as to impart a general rotation to test tube assembly 24 during the mixing process.

Figure 5:
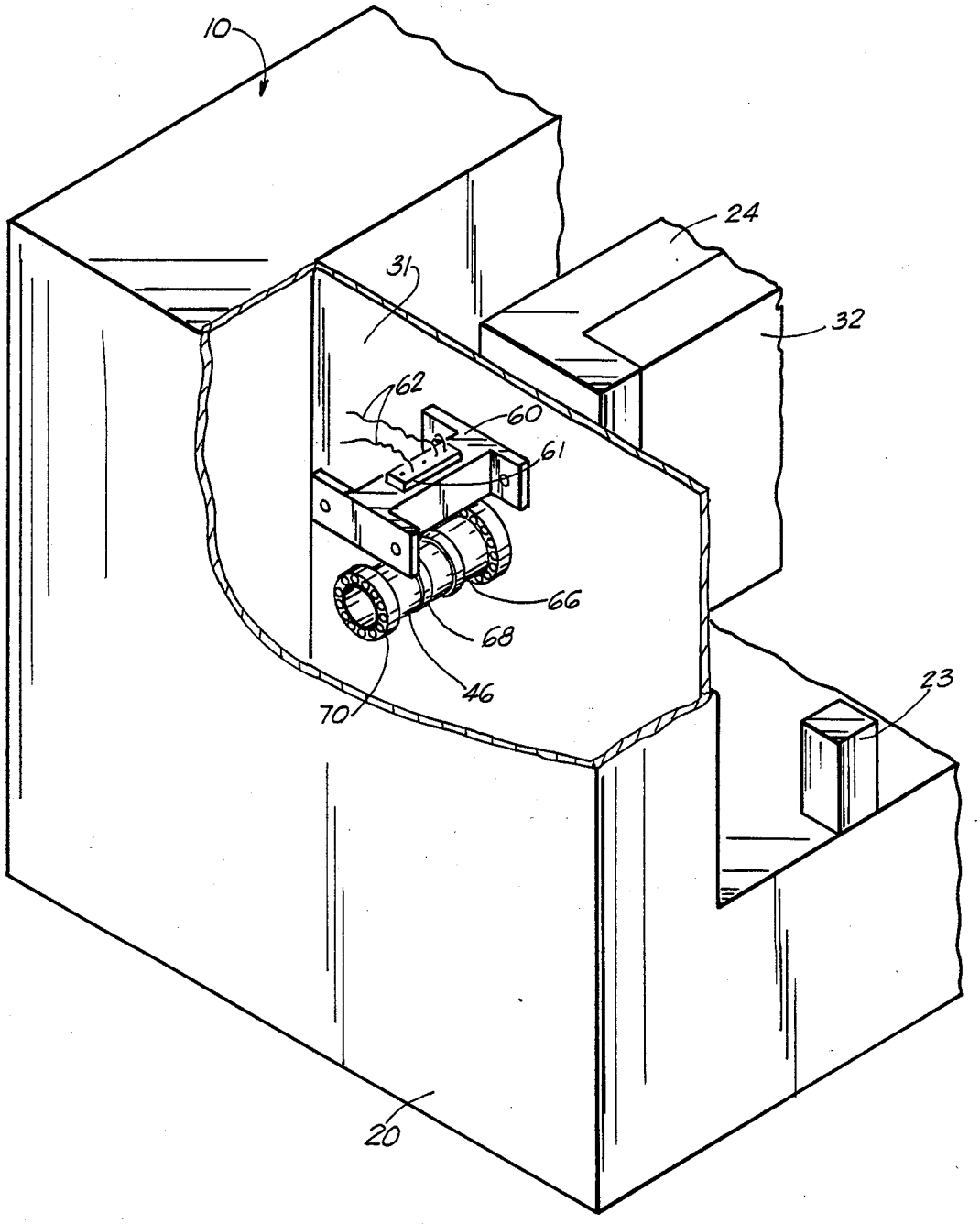
FIG. 5 illustrates a partial cutaway view of the heating component in the preferred embodiment of the apparatus of the present invention.
Figure 6:
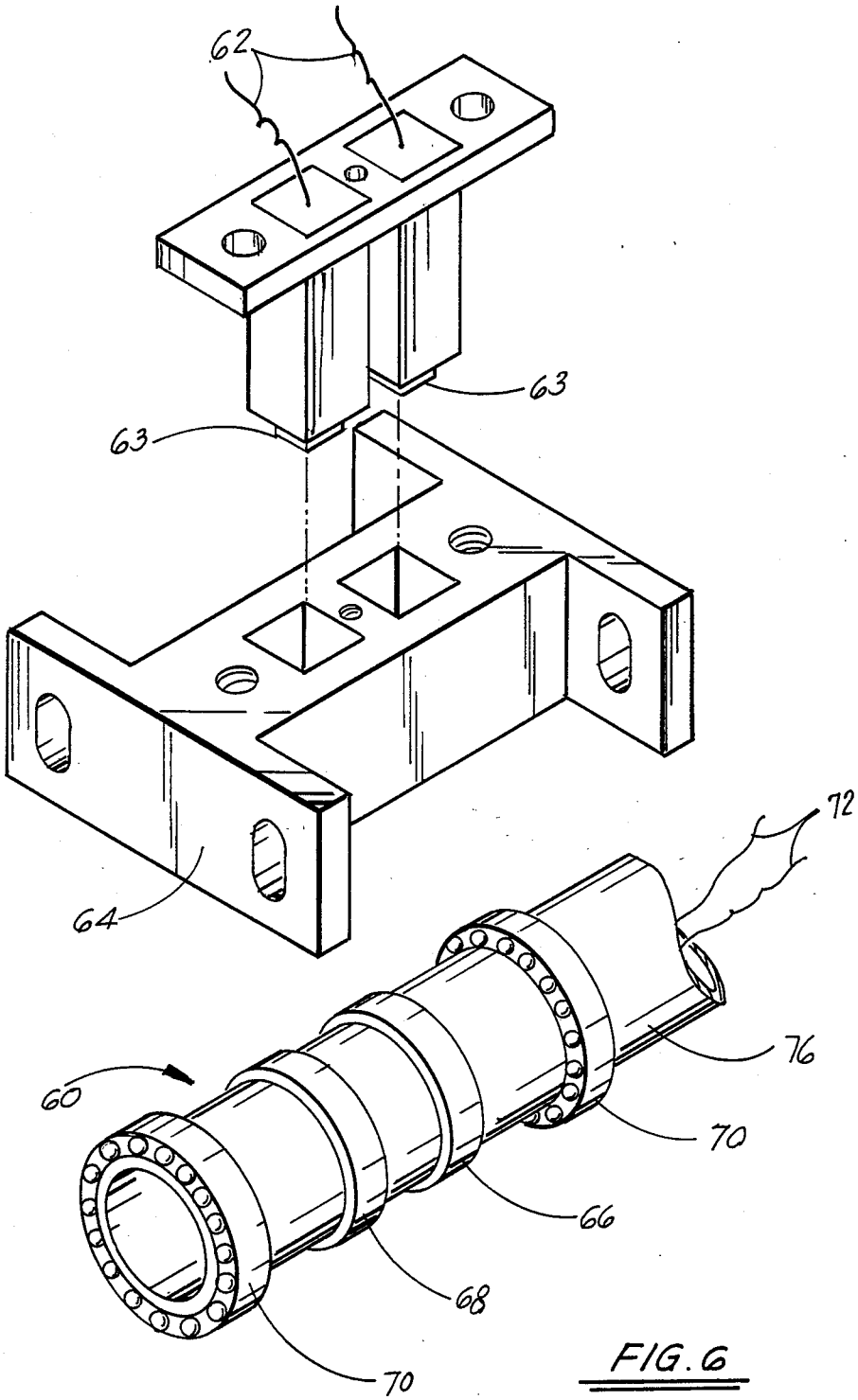
FIG. 6 illustrates an exploded view of the heating component in the preferred embodiment of the apparatus of the present invention.
Figure 7:
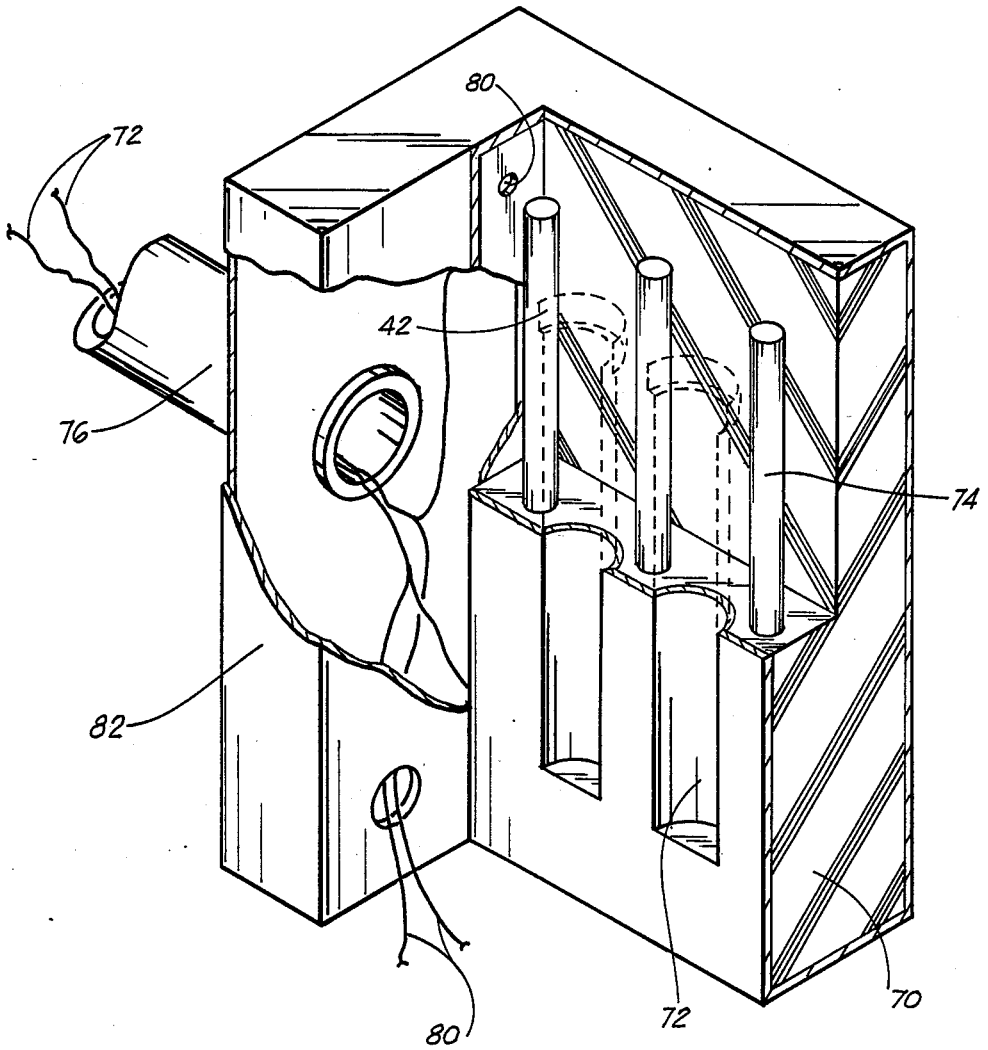
FIG. 7 illustrates an additional view of the heating component of the preferred embodiment of the apparatus of the present invention.
Figure 8:
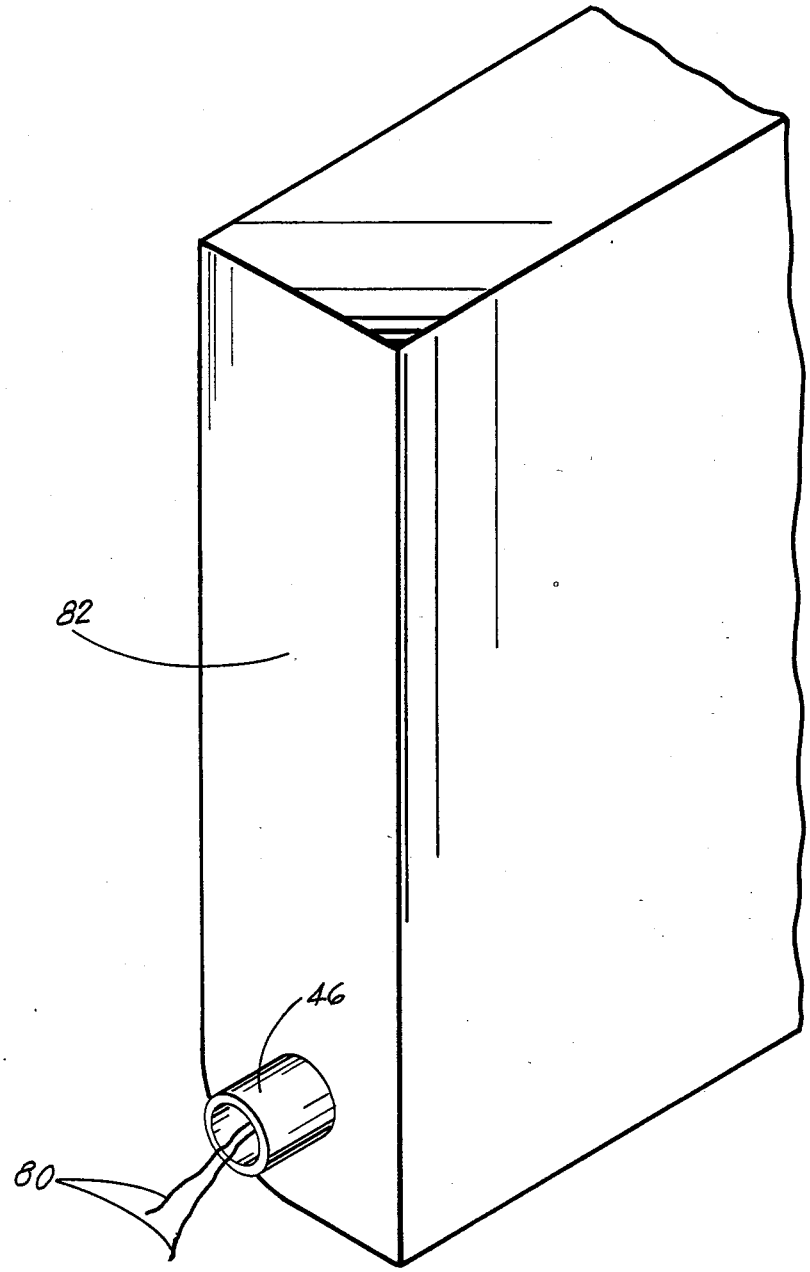
FIG. 8 is a side view of the wall portion of the apparatus of the present invention.

Turning now to the means for heating the test tubes during the rotation of the assembly, reference is made to FIG. 5. In FIG. 5 again there is illustrated apparatus 10 housing assembly 24, and further illustrating second shaft 46, extending through wall portion 31 of assembly 24. Since shaft 44 is accommodating the pulley wheel for rotating the assembly as seen in FIG. 4, shaft 46 serves as a means for accommodating the heating means for gently heating the test tubes as illustrated in FIGS. 5 and 6. In exploded view in FIG. 6 there is illustrated a brush ring assembly apparatus sixty wherein there is included a pair of wire leads 62 which connect to a thermostat which keeps the test tube cradles at a constant temperature of 37° C. The brushes 63 are maintained in position by a brush frame 64 bolted to the main frame 30. The two brushes 63 transmit the current to slip rings 66 and 68 respectively, which are insulated on shaft 46. The shaft 46 is supported by bearing 70. There is provided two wires 72 extending into the inside of shaft 46, which are attached to the two slip rings 66 and 68. The test tube assembly 24 would include an insulating material such as is illustrated in FIG. 7 as item 70 which maintains the test tubes (in phantom view) 72 at a constant temperature of 37° C. There are included six heating elements 74 which are extending upright intermediate each of the test tube cradle 40, which are interconnected by the pair of wires 72. The two leads 80, as illustrated in FIG. 7 pass through the lid holder hinge 82 (see FIG. 8), and interconnect the six heating elements 74 and the test tube holder lid. The heating elements are surrounded by insulating material 70, therefore, by having the test tube the heating elements both in the body of the assembly and in the door portion of the assembly, the test tubes are surrounded by a layer of heat through the insulating material 70, in order to maintain them at the proper temperature.

Therefore, in operation, the test tube assembly door 32 would be placed in the "open" position, the six or less test tubes filled with the blood specimens would be placed into the test tube holder assembly in cradles 40, and the door of 34 would be placed in the "closed" position. Following the closing of door 32, the control dials are set for the particular task that is to be undertaken i.e., mixing only, heating only, or mixing in temperature. Once a dial is set in the proper setting, the time dial is set for the proper time exposure, and the preparation will begin. During the entire preparation period, again the blood is gently mixed, and the blood is maintained at the proper temperature of 37°.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A thermostatically controlled blood mixer, comprising:

(a) a principal body portion;

(b) an assembly portion, for housing a plurality of test tubes containing blood specimen;

(c) heating means provided in the assembly for maintaining the blood specimens in the test tube at the desired temperature;

(d) a plurality of cradles contained within the assembly portion for accommodating each of the test tubes in each of the cradles;

(e) means for rotating the assembly portion at a predetermined speed in a tumbling fashion so that the specimens within the test tubes are gently mixed during the tumbling process; and (f) means, including a plurality of heating elements each positioned between a pair of cradles, so that the heat from the heating elements is evenly distributed to each of the cradles for maintaining the blood in the tubes within the cradles at 37° Centigrade.

2. The apparatus in claim 1, wherein the test tube assembly is attached to the body portion via a pair of shaft members upon which the assembly is rotated.

3. The apparatus in claim 1, wherein the assembly is rotated via a motor and pulley wheel drive assembly.

4. The apparatus in claim 1, wherein the heating means comprises a plurality of heating elements positioned intermediate the test tubes in the body of the assembly, and in a door portion of the assembly.

5. A thermostatically controlled blood mixer comprising;

(a) a generally rectangular body portion, having a recessed area for housing a test tube housing assembly;

(b) a plurality of cradles contained within the housing assembly for accommodating a plurality of test tubes in each of the cradles;

(c) a door portion, gaining access to the test tube assembly, so that in the "open" position test tubes may be loaded into the assembly, and in the "closed" position test tubes are secured within the confines of the assembly;

(d) a pair of shaft members interconnecting the assembly with the body portion along a central axis;

(e) a means for rotating the test tube assembly in a tumbling fashion so that the blood is gently mixed during the mixing process; and (f) means for heating the test tubes during the mixing process to a temperature of at least 37° C.

* * * * *